US007470090B2

(12) United States Patent
Heppner

(10) Patent No.: US 7,470,090 B2
(45) Date of Patent: Dec. 30, 2008

(54) LIFTING BRACKET SYSTEM SUPPORTED ON A PIER FOR LIFTING A FOUNDATION

(76) Inventor: Edward Heppner, RR1, S-31A, C-1, Kaleden, British Columbia (CA) V0H 1K0

( * ) Notice: Subject to any disclaimer, the term of this patent is extended or adjusted under 35 U.S.C. 154(b) by 215 days.

(21) Appl. No.: 11/451,340

(22) Filed: Jun. 13, 2006

(65) Prior Publication Data

US 2007/0286684 A1 Dec. 13, 2007

(51) Int. Cl.
*E02D 7/02* (2006.01)

(52) U.S. Cl. ..... 405/230; 248/219.3

(58) Field of Classification Search ..... 405/230; 254/133; 248/219.3

See application file for complete search history.

(56) References Cited

U.S. PATENT DOCUMENTS

| | | | | |
|---|---|---|---|---|
| 2,982,103 | A | 5/1961 | Revesz et al. | |
| 3,902,326 | A | 9/1975 | Langenbach, Jr. | |
| 4,673,315 | A | 6/1987 | Shaw et al. | |
| 4,678,373 | A | 7/1987 | Langenbach, Jr. | |
| 4,695,203 | A | 9/1987 | Gregory | |
| 4,708,528 | A | 11/1987 | Rippe | |
| 4,711,603 | A * | 12/1987 | Rippe, Jr. et al. | 405/230 |
| 4,765,777 | A | 8/1988 | Gregory | |
| 4,854,782 | A | 8/1989 | May | |
| 5,013,190 | A * | 5/1991 | Green | 405/230 |
| 5,120,163 | A | 6/1992 | Holdeman et al. | |
| 5,154,539 | A | 10/1992 | McCown, Sr. et al. | |
| 5,205,673 | A * | 4/1993 | Bolin et al. | 405/230 |
| 5,213,448 | A | 5/1993 | Seider et al. | |
| 5,492,437 | A | 2/1996 | Ortiz | |
| 5,724,781 | A | 3/1998 | Matthias et al. | |
| 5,800,094 | A | 9/1998 | Jones | |
| 6,079,905 | A | 6/2000 | Ruiz et al. | |
| 6,142,710 | A | 11/2000 | Holland et al. | |
| 6,352,390 | B1 | 3/2002 | Jones | |
| 2005/0214076 | A1 * | 9/2005 | Faires et al. | 405/230 |

FOREIGN PATENT DOCUMENTS

| | | |
|---|---|---|
| GB | 325 093 | 2/1930 |
| GB | 985 351 | 1/1963 |
| GB | 1 418 164 | 1/1974 |

* cited by examiner

*Primary Examiner*—John Kreck
(74) *Attorney, Agent, or Firm*—Antony C. Edwards

(57) ABSTRACT

A lifting bracket and associated lifting bracket system for mounting on an anchor pier for lifting generally horizontal building supports such as foundations, wherein the lifting bracket includes, collectively, a lifting plate, a gusset plate and a slide collar. The slide collar may be elongate and sized to fit snugly over an exposed upper end of the anchor pier for sliding engagement thereon. The lifting plate is mounted to the slide collar so as to extend cantilevered in a first direction substantially orthogonally therefrom, and so as to leave at least an upper portion of the slide collar extending upwardly from the lifting plate. The gusset plate is rigidly mounted at a lower edge thereof to an upper surface of the lifting plate so as to extend substantially entirely across the lifting plate in a second direction substantially orthogonal to the first direction, and is rigidly mounted at at least an upper portion thereof to the upper portion of the slide collar disposed above the lifting plate. The gusset plate extends rigidly from at least the upper portion of the slide collar to the lifting plate.

19 Claims, 7 Drawing Sheets

14a

A
14
12a
24
B
22
24
20
14b
10
E
16
12
18
A

LIFTING BRACKET SYSTEM SUPPORTED ON A PIER FOR LIFTING A FOUNDATION

FIELD OF THE INVENTION

The present invention relates generally to systems for stabilizing the foundation of a building structure which may or has experienced settlement or movement and, more particularly, to an apparatus for stabilizing the foundation of a building against settling or other forces by jacking the foundation up against, and mounting the foundation to, an anchoring pier such as a helically anchored pier by the use of a reinforced bracket and gusset plate mounted to the foundation.

BACKGROUND OF THE INVENTION

It is known to provide a foundation jacking tool assembly for use in stabilizing the foundation of a building, wherein a screw anchor or pier is driven into the ground adjacent the foundation, a support is positioned at the bottom of a foundation, a lifting force is applied to the support and foundation using the screw anchor or pier as a base for the lifting force applied to the support and hence the foundation so that the foundation loads are transferred to the screw anchor or pier. In particular, in the prior art applicant is aware of U.S. Pat. No. 5,120,163, issued Jun. 9, 1992 to Holdeman et al. for a Foundation Underpinning Bracket and Jacking Tool Assembly, U.S. Pat. No. 5,171,107, issued Dec. 15, 1992 to Hamilton et al. for a Method of Underpinning Existing Structures, U.S. Pat. No. 5,213,448, issued May 25, 1993, to Seider et al. for an Underpinning Bracket for Uplift and Settlement Loading, and U.S. Pat. No. 6,539,685, issued Apr. 12, 2003, to Bell et al. for an Apparatus and Method for Lifting Sunken Foundations.

As described by Bell et al. in U.S. Pat. No. 6,539,685, the slow settling of the foundations of buildings, concrete slabs, and other heavy structures is a phenomenon occurring occasionally in various areas, particularly where the underlying soil is not stable. As a result, various equipment and techniques have been developed for lifting sunken or settled foundations, slabs, etc. These techniques generally involve the digging of a hole or trench along the structure to be lifted, and driving one or more pipes or piers into the ground adjacent to the structure until the pipes reach stable material or the underlying bedrock. A lifting apparatus is then installed on the support pier and extended beneath a portion of the structure to be raised. Typically a hydraulic lift is used to lift the lifting apparatus and structure resting thereon. This process is conducted simultaneously every several feet as needed along the length of the structure being raised, in order to distribute the lifting forces generally equally along the structure.

Another problem incurred using many of the devices of the prior art, is that many such devices do not provide any form of mechanical locking to secure the lifting element (plate, arm, etc.) to its corresponding anchor pier or pipe. The lifting component is raised by one or more hydraulic jacks, but some means must be provided to secure the lifting component to the pier, before the hydraulic devices can be removed. Bell consequently provides an apparatus for lifting and stabilizing sunken or settled foundations, slabs, footings, etc. which includes a lifting plate having a pipe section solidly secured thereto, for passing concentrically over the anchor pier. A single clamp is adjustably positionable along the length of the pipe so that the clamp may be secured to a solid area of the foundation structure. The plate is secured to the pier using mechanical fasteners.

SUMMARY OF THE INVENTION

In summary, the present invention may be characterized as a lifting bracket and associated lifting bracket system for mounting on an anchor pier for lifting generally horizontal building supports such as foundations, wherein the lifting bracket includes, collectively, a lifting plate, a gusset plate and a slide collar. The slide collar may be elongate and sized to fit snugly over an exposed upper end of the anchor pier for sliding engagement thereon. The lifting plate is mounted to the slide collar so as to extend cantilevered in a first direction substantially orthogonally therefrom, and so as to leave at least an upper portion of the slide collar extending upwardly from the lifting plate. The gusset plate is rigidly mounted at a lower edge thereof to an upper surface of the lifting plate so as to extend substantially entirely across the lifting plate in a second direction substantially orthogonal to the first direction, and is rigidly mounted at at least an upper portion thereof to the upper portion of the slide collar disposed above the lifting plate. The gusset plate extends rigidly from at least the upper portion of the slide collar to the lifting plate. A plurality of apertures may be formed in the gusset plate so that corresponding fasteners when journalled through the apertures extend parallel to the first direction so as to engage a side surface of a building support when a lower edge of the building support is resting on the lifting plate with the side surface abutting the gusset plate.

In the system according to one aspect of the present invention a substantially parallel pair of lifting rods are mounted to the lifting plate so as to extend substantially vertically upwardly therefrom. They may be spaced substantially equally from opposite lateral sides of the slide collar. A rigid first cross member is adapted for mounting on top of the exposed upper end of the anchor pier so as to bring opposite ends of the first cross member into proximity to the pair of rods. A first pair of position locks such as threaded nuts in one embodiment where the rods are threaded and journalled through holes in the ends of the first cross member, cooperate with the ends of the first cross member so as to selectively engage the pair of lifting rods to selectively prevent movement of the pair of lifting rods relative to the first cross member once the lifting bracket has been hoisted on the pair of lifting rods to elevate the building support relative to the anchor pier to a desired elevation.

A rigid second cross member is rigidly mounted to, so as to extend between upper ends of the pair of lifting rods. A selectively actuable jack is mounted or mountable between, so as to engage, and be sandwiched therebetween, the horizontal first and second cross members. The jack is also between the vertical pair of lifting rods. Extension of the jack elevates the upper, that is the second cross member. This lifts the pair of lifting rods and the lifting plate relative to both the lower, first cross member and the anchor pier to thereby elevate the building support resting on the lifting plate. Once so elevated, the first pair of position locks are selectively engaged with the pair of lifting rods and the first cross member, for example by tightening nuts on rods down onto the first cross member, to lock the vertical position of the pair of lifting rods and the lifting bracket relative to the anchor pier.

The first cross member includes a rigid post depending downwardly therefrom for mounting in the hollow upper end of the top of the pier protruding from the ground. The post extends vertically downwardly from the first cross member and fits snugly into the top of the pier to assist in stabilizing the first cross member and maintaining it level during jacking using the bottle jack to raise the second cross member and hence the lifting plate.

In one embodiment the lifting plate is mounted to the pair of lifting rods by a second pair of position locks, again for example threaded nuts, which are selectively engageable so as to lockably engage the pair of lifting rods to the lifting plate. The second cross member may be mounted to the pair of lifting rods by a third pair of position locks, again for example threaded nuts, which are selectively engageable so as to lockably engage the pair of lifting rods to the second cross member. Thus, as stated, where the pair of lifting rods are threaded rods, the first, second and third position locks may include threaded nuts threadably mounted on the threaded rods, for selective translation therealong.

The first and second cross members may each include an elongate channel member having channel flanges extending from a rigid web plate and between the pair of lifting rods. The first cross member may have a pair of slide openings therein for sliding of the pair of lifting rods therethrough relative to the first cross member. The pair of slide openings may be formed in the ends of the first cross member, for example as apertures in the web of the channel member.

The lifting plate has a forward edge for engaging in the first direction under the building support and a rear edge opposite the front edge. The slide collar may be mounted to the lifting plate adjacent the rear edge of the lifting plate. The gusset plate may be mounted substantially orthogonally to the lifting plate on a front side of the slide collar opposite to an opposite rear side of the slide collar adjacent the rear edge of the lifting plate.

A lower portion of the slide collar may extend below and substantially orthogonally from a lower surface of the lifting plate. Lower gussets may be mounted below and abutting against the lower surface of the lifting plate and against a front surface of the lower portion of the slide collar so as to extend rigidly between the slide collar and the lifting plate for resisting bending moments applied to the front edge of the lifting plate.

A pair of apertures may be formed in the lifting plate on opposite lateral sides thereof, the pair of apertures spaced apart substantially equally from opposite lateral sides of the slide collar. The pair of apertures are for receiving the pair of lifting rods therethrough.

The present invention also includes a method of lifting a foundation, in which: at least one anchor pier is driven into the underlying ground; the system described above is provided and the lifting plate mounted on the exposed upper end by sliding the slide collar of the plate over the upper end of the pier so as to journal the upper end of the pier through the slide collar, positioning the lifting plate snugly under the adjacent lower edge of the foundation, and fastening the gusset plate to the foundation. A single portable hydraulic jack, for example a so-called bottle jack is placed atop the first cross member on the top of the pier. The jack then lifts the overlying second cross member. The second cross member is attached to the lifting plate by the pair of lifting rods so that extending the jack raises the lifting plate and foundation. After the foundation has been raised so as to stabilize it as required, the first cross member is immovably secured to the lifting plate by tightening the threaded nuts down along the threaded rods down snugly onto the top of the first cross member. The overlying second cross member and the hydraulic jack are then removed.

BRIEF DESCRIPTION OF THE DRAWINGS

With reference to the drawings wherein similar characters of reference denote corresponding parts in each view.

DETAILED DESCRIPTION OF EMBODIMENTS OF THE INVENTION

Figure 1:
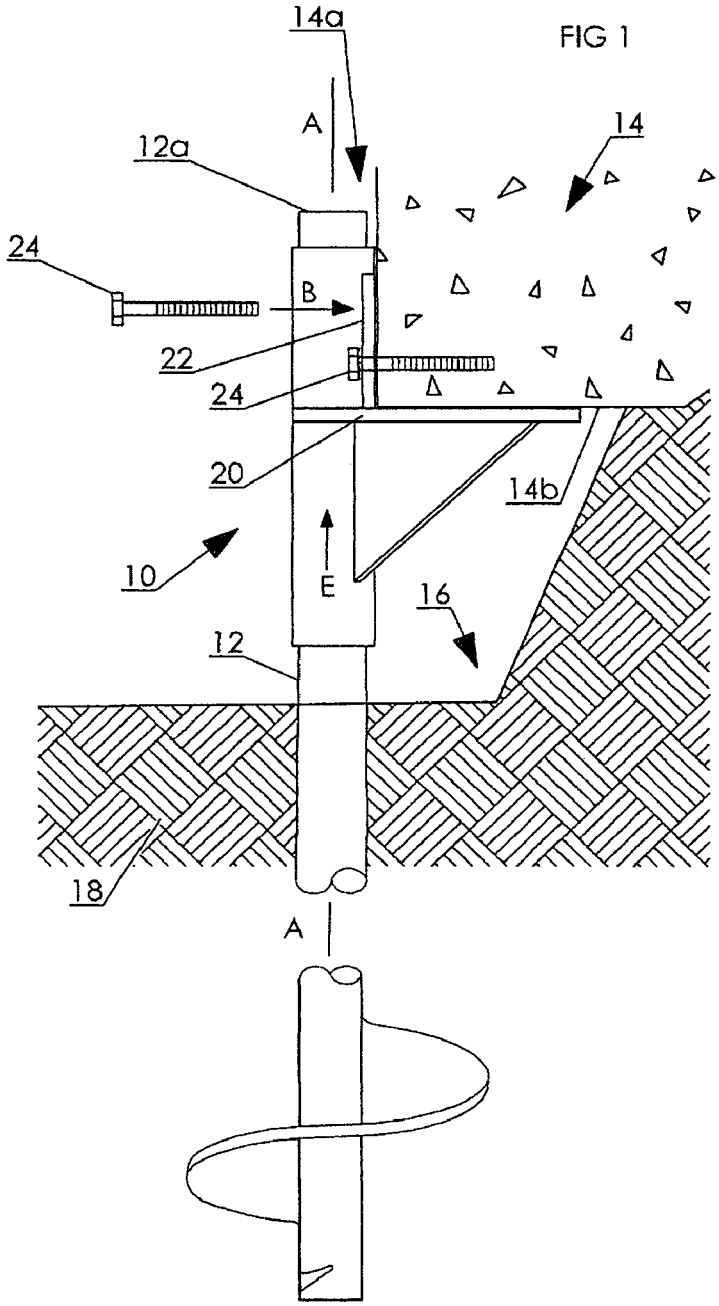
FIG. 1 is in a partially cut away sectional view through a foundation and excavation, a side elevation view of the lifting bracket according to one aspect of the present invention mounted on an anchor pier.
Figure 2:
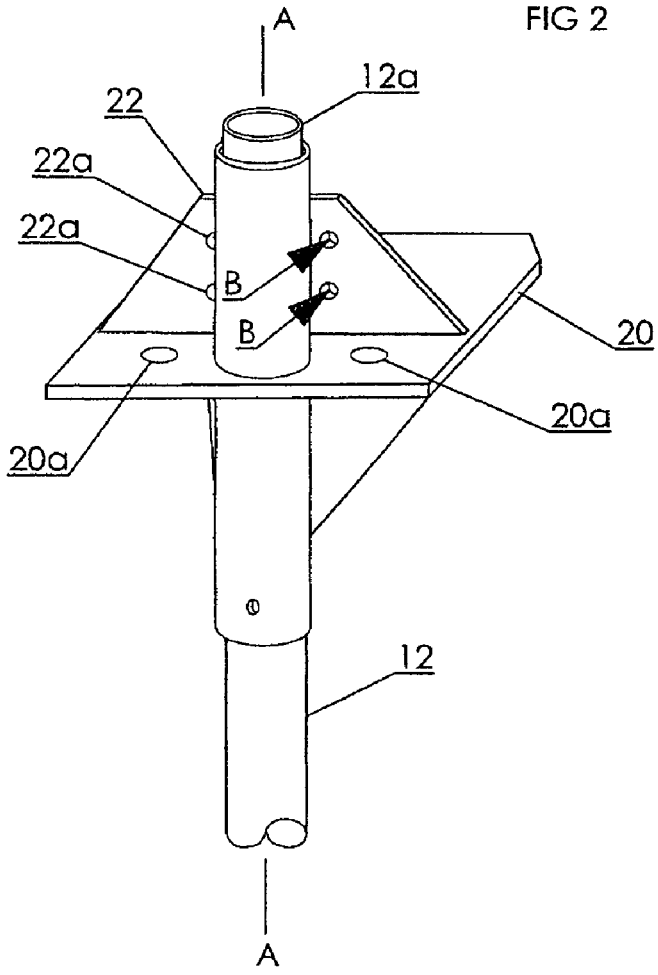
FIG. 2 is, in rear perspective view, the lifting bracket mounted on an anchor pier of FIG. 1.
Figure 3:
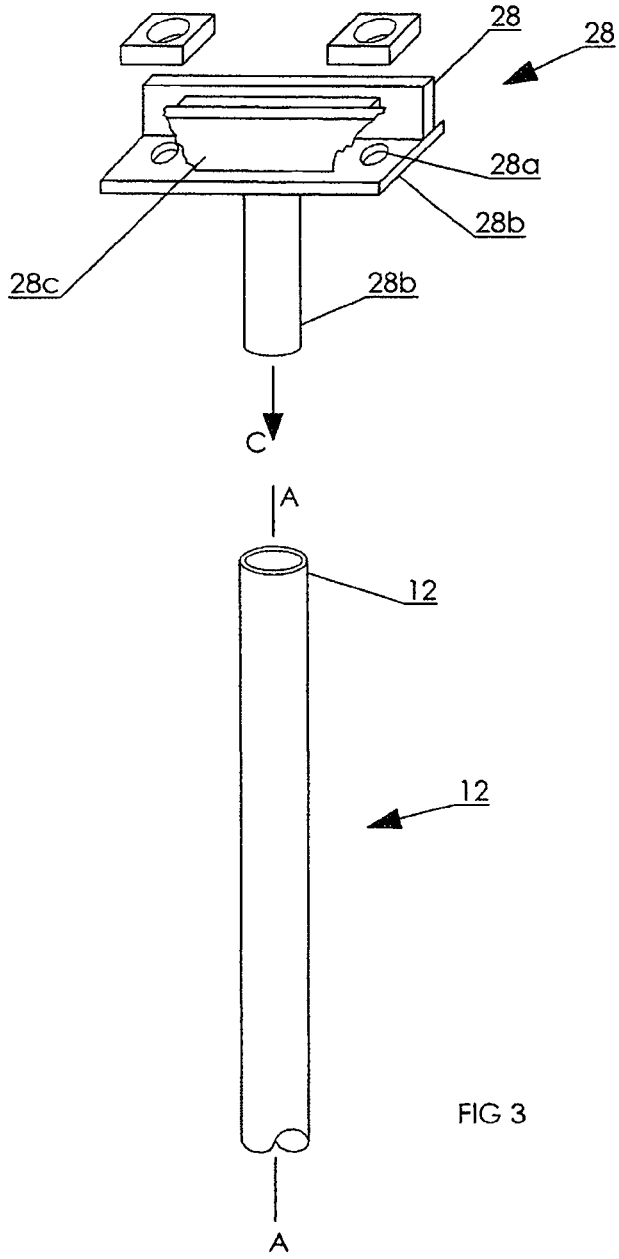
FIG. 3 is, in rear perspective partially exploded view, a jack supporting cross member mounting into the upper end of an anchor pier.
Figure 4:
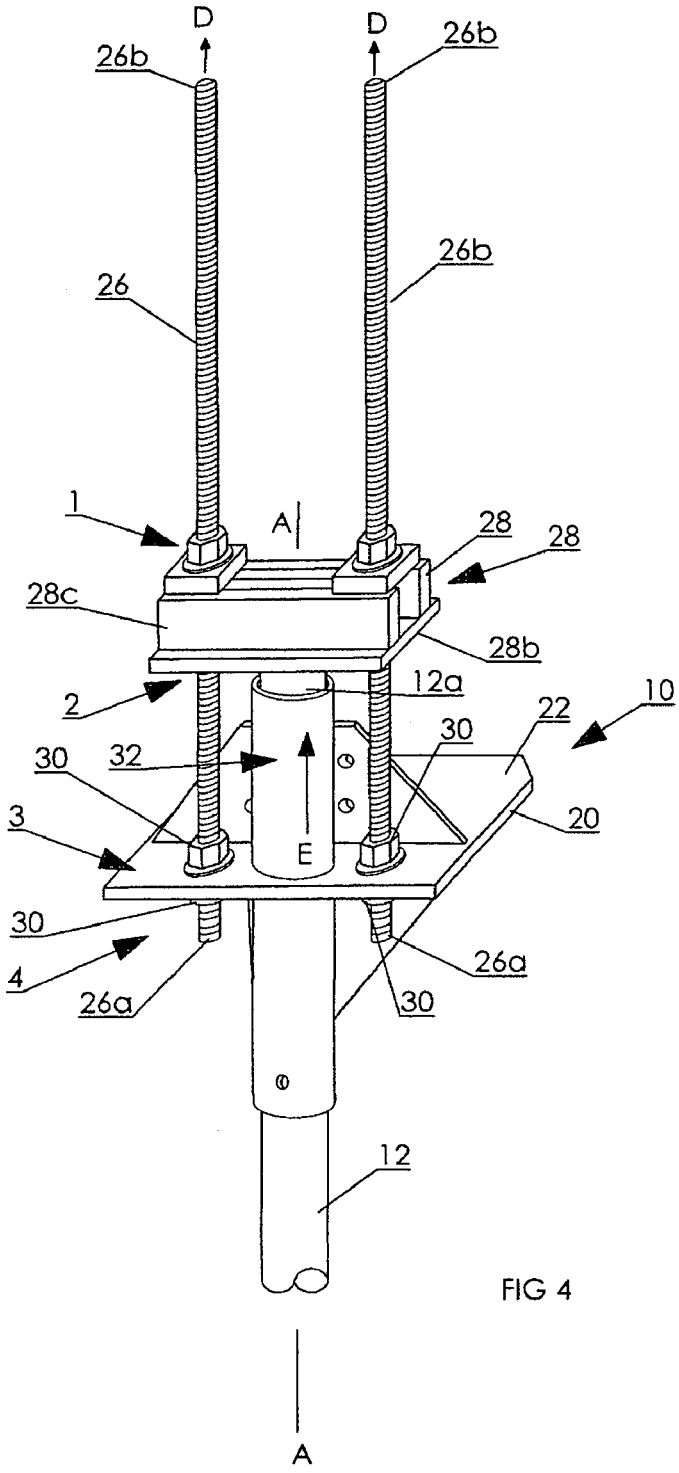
FIG. 4 is, in rear perspective view, the lift bracket and anchor pier of FIG. 2 with the cross member of FIG. 3 mounted thereon and supported therebetween by a pair of vertical lifting rods.
Figure 5:
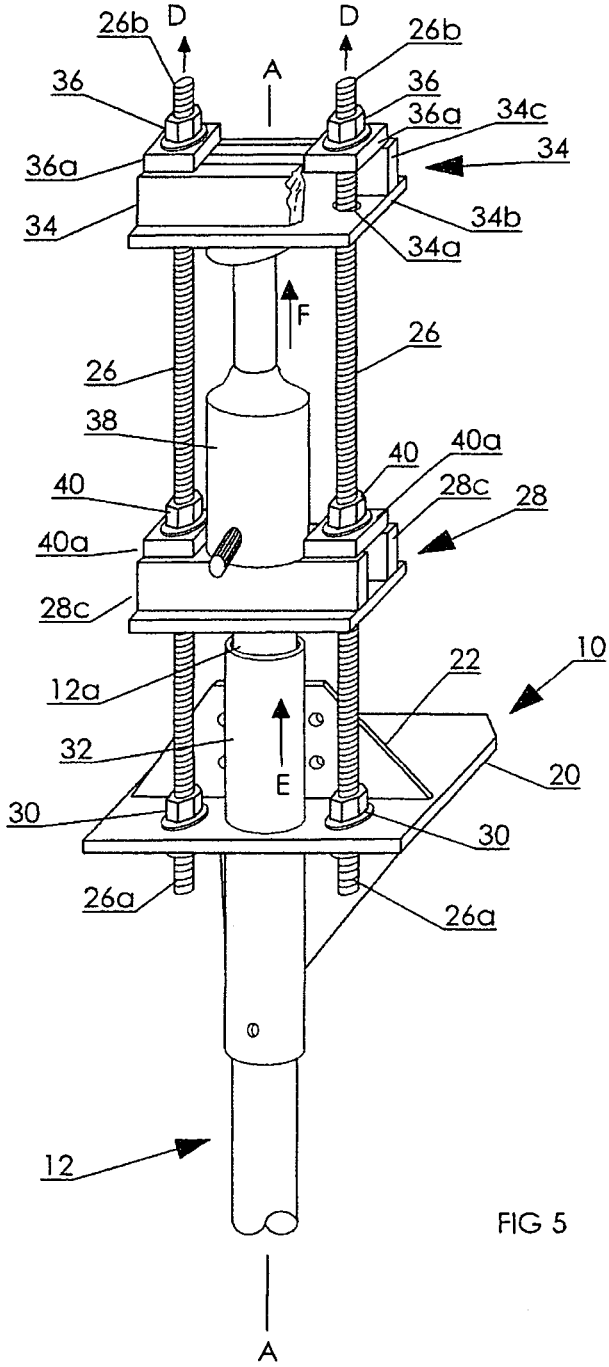
FIG. 5 is, in rear perspective view, the lifting bracket system according to one aspect of the present invention illustrating a jack mounted on the cross member of FIG. 4 and lifting upwardly the lifting rods by means of a second cross member mounted to the rods and on top of the jack.

FIG. 1 illustrates how, in use, lifting bracket 10 is slidably mounted onto the exposed upper end 12*a* of an anchor pier 12. The anchor pier, which may be in the form of a helical screw pier as illustrated, is installed along axis A so as to extend vertically and substantially parallel to an exterior side surface 14*a* of a foundation 14, footing or like horizontal building support to be stabilized. Anchor pier 12 is installed so as to extend downwardly from the bottom of an excavation 16 which has been made to expose side 14*a* and the underside 14*b* of foundation 14. Anchor pier 12 is installed into soil 18 so that lifting bracket 10, when mounted onto anchor pier 12, is sufficiently close to footing 14 so that lifting plate 20 and gusset plate 22 may be snugged up against underside 14*b* and side 14*a* respectively of foundation 14.

Once lifting bracket 10 has been snugged up against and under foundation 14 so as to engage lifting plate 20 with the underside of the foundation and so as to engage gusset plate 22 against the exposed outside surface of the foundation, and with the lifting plate and gusset plate substantially flush against the respective surfaces of the foundation, fasteners such as bolts 24 are inserted through bolt holes 22*a* in gusset plate 22 in direction B into footing 14 so as to secure lifting bracket 10 to the foundation.

Once lifting bracket 10 has been thus secured to foundation 14 the balance of the lifting system may be installed. In particular, threaded lifting rods 26 are slidably journalled through slightly oversized apertures 28*a* in a channelled first cross member 28. Cross member 28 is mounted into the upper hollow exposed end 12*a* of anchor pier 12 by insertion of post 28*b* slidably and snugly into end 12*a* in direction C. The lower ends 16*a* of lifting rod 16 are journalled through slightly oversized apertures 20*a* in lifting plate 20. Nuts 30 threadably mounted onto lower ends 26*a* of lifting rods 26 are snugged against lifting plate 20 so as to securely sandwich the rim of lifting plate 20 around apertures 20*a* between nuts 30 to thereby rigidly mount lifting bracket 10 to the pair of lifting rods 26.

With lifting rods 26 rigidly mounted to lifting plate 10, whether it be by the use of threaded nuts or by other fasteners or by other means of attachments such as welding or the like, pulling upwardly on the upper ends 26*b* of lifting rods 26 in direction D slides lifting rods 26 through apertures 28*a* in cross member 28 and simultaneously lifts lifting bracket 10. Slide collar 32 on lifting plate 20 is free to slide upwardly over upper end 12*a* of anchor pier 12 towards the channel web 28*b* of the elongate laterally disposed channel formed by web 28*b* and parallel flanges 28*c*. Slide collar 32 is mounted so as to be substantially perpendicular, that is, orthogonal to a plane containing the planar lifting plate 20. Advantageously, slide collar 32 is elongate and may extend orthogonally upwardly and downwardly as illustrated from lifting plate 20.

In order to apply tension in direction D to the upper ends 26*b* of lifting rods 26, so as to thereby cause lifting movement in direction E of lifting bracket 10 relative to anchor pier 12 to thereby elevate foundation 14, a second rigid cross member 34, which may also be formed as an inverted laterally elongate channel section such as employed for first cross member 28, is mounted to upper ends 26*b* of lifting rods 26. This is done for example by the threaded engagement of nuts 36 sandwiching washers 36*a* down against the laterally extending parallel upstanding flanges 34*c* extending upwardly from web 34*b*, upper ends 26*b* of rods 26 journalled through apertures 34*a* in web 34*b*.

A jack 38, which may be a so-called bottle jack as illustrated, is mounted between the first and second cross members 28 and 34 respectively. In particular, the base of bottle jack 38 rests centered on flanges 28*c* disposed medially between nuts 40 and corresponding washers 40*a*, and so as to dispose the upper end of the jack against the underside of web 34*b*. As the upper end of jack 38 is extended upwardly the corresponding lifting force F drives cross member 34 upwardly against nuts 36 threadably mounted onto upper ends 26*b*. Thus lifting force F and the upward movement of the upper end of jack 38 translates directly into the lifting of lifting rods 26 in direction B and the corresponding simultaneous lifting of lifting bracket 10 in direction E, lifting force F being resisted by cross member 28 resting on the upper end 12*a* of anchor pier 12.

Figure 6:
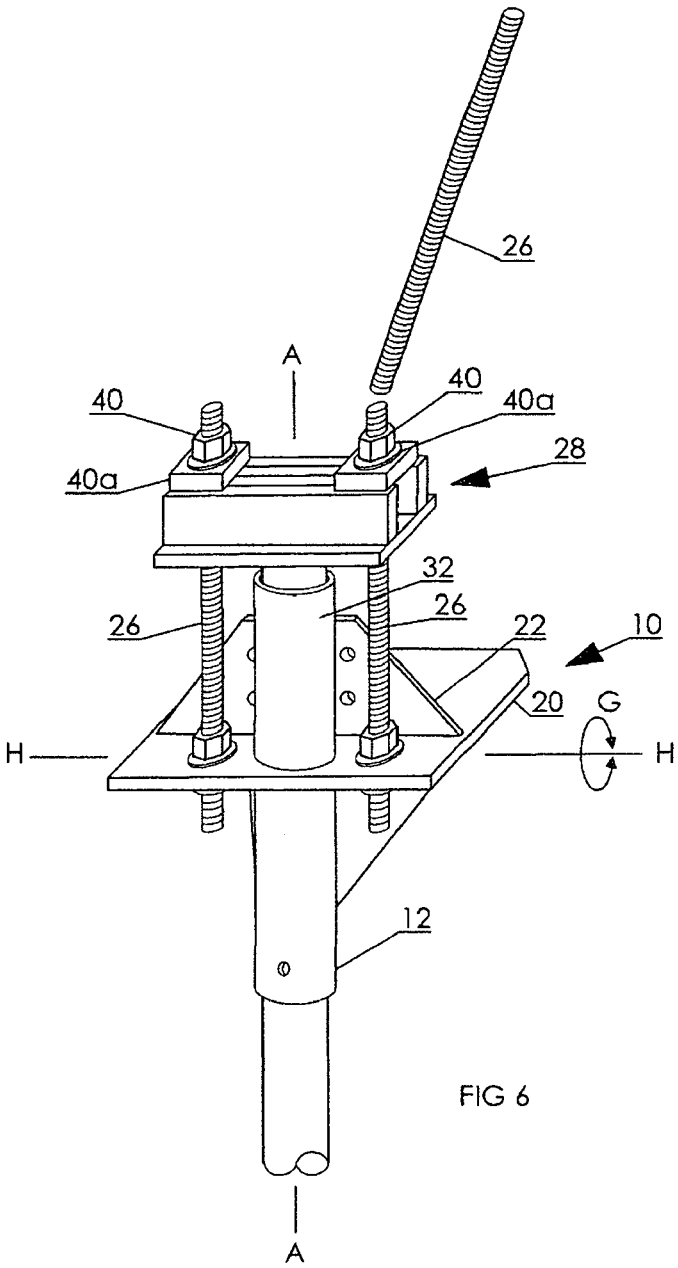
FIG. 6 is the lifting bracket system of FIG. 5 with the lifting complete and the upper ends of the lifting rods being removed.
Figure 7:
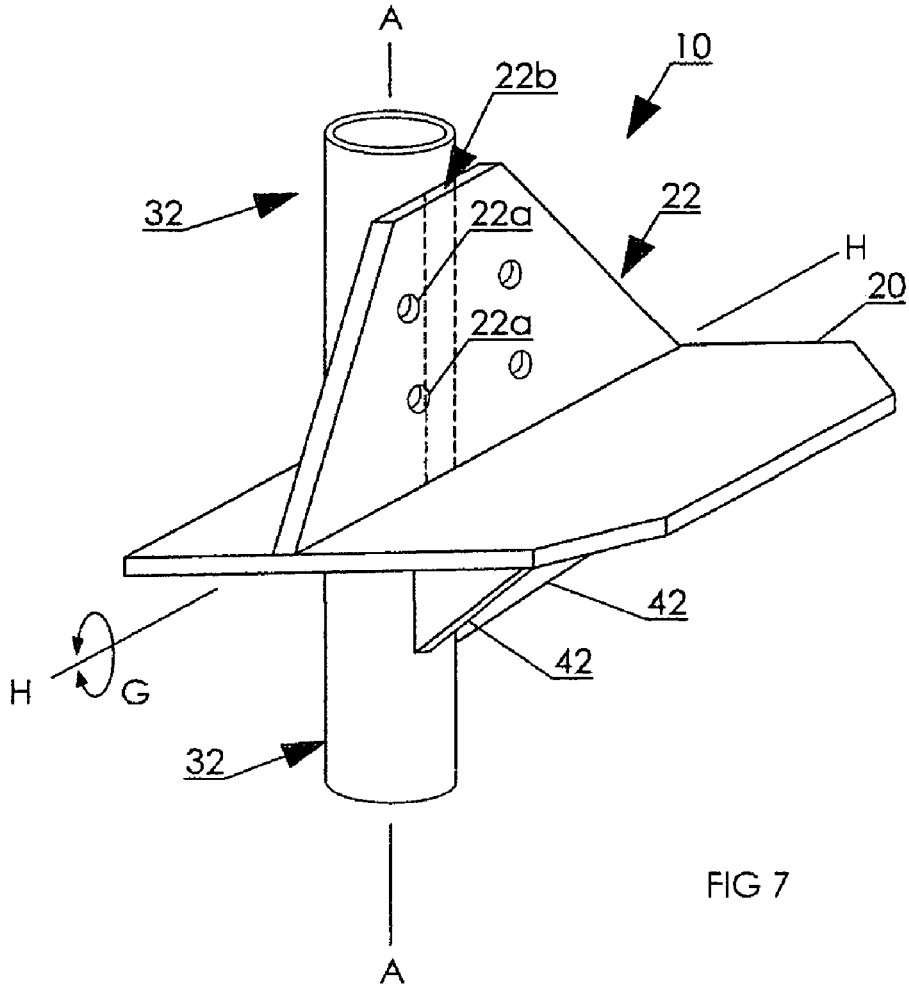
FIG. 7 is, in front perspective view, the lifting bracket of FIG. 2.

Once lifting plate 10 has been elevated sufficiently, that is so as to lift and stabilize foundation 14, nuts 40 are snugged down against washers 40*a* and cross member 28 so as to take up the lifting load being transferred from lifting plate 10 through lifting rods 26. With the load thus transferred from the second cross member 34 to the first cross member 28, jack 38 may be retracted from under cross bar 34 and removed, and then lifting rods 26 severed above nuts 40 as seen in FIG. 6 and removed. The remaining structure is then left in place supporting foundation 14.

It will be appreciated that the load from foundation 14 applied to lifting bracket 10 is substantial, even though many lifting brackets 10 may be deployed in relatively closely spaced apart array on corresponding anchor piers along the length of the foundation. The loads are substantial especially at locations where the foundation may have a fault allowing for differential movement of the foundation on either side of the fault due to further settling of unstable soil 18, due to frost heaving or other environmental conditions resulting in raising or lowering of the foundation, and in particular differential movement of the foundation on either side of a fault. In such circumstances, where there is differential movement on either side of a fault in particular, the loading on the most closely adjacent lifting plates 10 nearest the fault will be magnified. Further, the forces exerted on a particular lifting plate 10 by foundation 14 may not necessarily be a downward settling force but may also be an upwardly heaving force, for example resulting from the differential movement of the foundation along the fault. Further, the movement of the foundation, for example the differential movement of the foundation on either side of a fault, is not necessarily strictly vertical movement, but may also entail a slight creep or lateral shift resulting in a shear vector normal to axis A. Thus movement of foundation 14 during heaving or slumping thereby causing bending moments applied to lifting plate 20, combined with a possibility of shearing forces, means that the resulting forces on the sections of the lifting rods 26 extending between lifting plate 20 and cross member 28 are not necessarily strictly in tension the lifting rods. Quite apart from bending moment G about an axis of rotation normal to axis A and generally indicated by axis H, asymmetric loading due to movement of foundation 14 may, if not properly resisted, induce forces such as shearing forces and buckling forces in lifting rods 26 which they are not well suited to withstand.

Consequently, gusset plate 22 is rigidly mounted, for example by welding, along its lowermost edge to the upper surface of lifting plate 20 generally parallel to axis H and rigidly mounted, again for example by welding, along a vertical seam 22*b* between the rear face of gusset plate 22 and the front face of the upper portion of slide collar 32. Gusset plate 22 therefore lends rigidity to the upper part of the structure formed by slide collar 32 and lifting plate 20 so as resist de-formation due to asymmetric loading, cyclical heaving and slumping, shearing or other forms of stress inducing movement of the foundation. Bending moments are also resisted on the underside of lifting plate 20 by gussets 42 mounted to the lower portion of slide collar 32. Thus the use of gusset plate 22 increases the structural rigidity so as to minimize such de-formations such as bending or buckling of the lifting rods 26 whose sole function it should be is to resist in tension a dropping of the foundation onto lifting plate 20. Further, the provision for fastening, for example by bolting, of gusset plate 22 to the side surface 14*a* of foundation 14 increases the rigidity of the supporting structure thereby minimizing asymmetric or cyclical loading transferred to one or the other of the lifting rods 26, or for that matter the anchor pier 12.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A lifting bracket for mounting on an anchor pier for use in a system for lifting horizontal building supports such as foundations, the bracket comprising:

a lifting plate, a gusset plate and a slide collar, said slide collar elongate and sized to fit snugly over an exposed upper end of the anchor pier for sliding engagement thereon, said lifting plate mounted to said slide collar so as to extend cantilevered in a first direction substantially orthogonally therefrom, and so as to leave at least an upper portion of said slide collar extending upwardly from said lifting plate, said gusset plate rigidly mounted at a lower edge thereof to an upper surface of said lifting plate so as to extend substantially entirely across said lifting plate in substantially a second direction orthogonal to said first direction, said gusset plate rigidly mounted at at least an upper portion thereof to said at least an upper portion of said slide collar disposed above said lifting plate, said gusset plate extending rigidly from said at least an upper portion of said slide collar to said lifting plate, a plurality of apertures formed in said gusset plate so that corresponding fasteners when journalled through said apertures extend parallel to said first direction so as to engage a side surface of a building support when a lower edge of the building support is resting on said lifting plate with the side surface abutting said gusset plate, wherein said lifting plate has a forward edge for engaging in said first direction under the building support and a rear edge opposite said front edge, and wherein said slide collar is mounted to said lifting plate adjacent said rear edge of said lifting plate, and wherein said gusset plate is mounted substantially orthogonally to said lifting plate on a front side of said slide collar opposite an opposite rear side of said slide collar adjacent said rear edge of said lifting plate.

2. The lifting bracket of claim 1 wherein a lower portion of said slide collar extends below and substantially orthogonally from a lower surface of said lifting plate, and wherein lower gussets are mounted below and abutting against said lower surface of said lifting plate and against a front surface of said lower portion of said slide collar so as to extend rigidly between said slide collar and said lifting plate for resisting bending moments applied to said front edge of said lifting plate.

3. The lifting bracket of claim 1 wherein a pair of apertures are formed in said lifting plate on opposite lateral sides thereof, said pair of apertures spaced apart equally from opposite lateral sides of said slide collar, said pair of apertures for receiving therethrough a corresponding pair of parallel lifting rods.

4. A lifting bracket system for mounting on an anchor pier for lifting horizontal building supports such as foundations, the system comprising:

a lifting plate, a gusset plate and a slide collar collectively forming a lifting bracket, said slide collar elongate and sized to fit snugly over an exposed upper end of the anchor pier for sliding engagement thereon, said lifting plate mounted to said slide collar so as to extend cantilevered in a first direction substantially orthogonally therefrom, and so as to leave at least an upper portion of said slide collar extending upwardly from said lifting plate, said gusset plate rigidly mounted at a lower edge thereof to an upper surface of said lifting plate so as to extend substantially entirely across said lifting plate in substantially a second direction orthogonal to said first direction, said gusset plate rigidly mounted at at least an upper portion thereof to said at least an upper portion of said slide collar disposed above said lifting plate, said gusset plate extending rigidly from said at least an upper portion of said slide collar to said lifting plate, a plurality of apertures formed in said gusset plate so that corresponding fasteners when journalled through said apertures extend parallel to said first direction so as to engage a side surface of a building support when a lower edge of the building support is resting on said lifting plate with the side surface abutting said gusset plate, a substantially parallel pair of lifting rods mounted to said lifting plate so as to extend vertically upwardly therefrom and spaced substantially equally from opposite lateral sides of said slide collar, a rigid first cross member adapted for mounting on top of the exposed upper end of the anchor pier so as to bring opposite ends of said first cross member into proximity to said pair of rods, a first pair of position locks cooperating with said ends of said first cross member so as to selectively engage said pair of lifting rods to selectively prevent movement of said pair of lifting rods relative to said first cross member once said lifting bracket has been hoisted on said pair of lifting rods to elevate the building support relative to the anchor pier to a desired elevation, a rigid second cross member rigidly mounted to, so as to extend between upper ends of said pair of lifting rods, a selectively actuable jack mounted between, so as to engage, said first and second cross members between said pair of lifting rods, wherein extension of said jack elevates said second cross member and said pair of lifting rods and said lifting plate relative to said first cross member and the anchor pier to thereby elevate the building support resting on said lifting plate, and wherein, once so elevated, said first pair of position locks are selectively engaged with said pair of lifting rods and said first cross member to lock the vertical position of said pair of lifting rods and said lifting bracket relative to the anchor pier.

5. The system of claim 4 wherein said lifting plate is mounted to said pair of lifting rods by a second pair of position locks selectively engageable so as to lockably engage between said pair of lifting rods and said lifting plate.

6. The system of claim 5 wherein said second cross member is mounted to said pair of lifting rods by a third pair of position locks selectively engageable so as to lockably engage between said pair of lifting rods and said second cross member.

7. The system of claim 6 wherein said pair of lifting rods are threaded rods and said first, second and third position locks include threaded nuts threadably mounted on, for selective translation along said threaded rods.

8. The system of claim 4 wherein said first cross member includes an elongate channel member having channel flanges extending from and between said pair of lifting rods.

9. The system of claim 8 wherein said first cross member has a pair of slide openings therein for sliding of said pair of lifting rods therethrough relative to said first cross member.

10. The system of claim 9 wherein said pair of slide openings are formed in said ends of said first cross member, in a web of said channel member.

11. The system of claim 4 wherein said lifting plate has a forward edge for engaging in said first direction under the building support and a rear edge opposite said front edge, and wherein said slide collar is mounted to said lifting plate adjacent said rear edge of said lifting plate, and wherein said gusset plate is mounted substantially orthogonally to said lifting plate on a front side of said slide collar opposite an opposite rear side of said slide collar adjacent said rear edge of said lifting plate.

12. The system of claim 11 wherein a lower portion of said slide collar extends below and substantially orthogonally from a lower surface of said lifting plate, and wherein lower gussets are mounted below and abutting against said lower surface of said lifting plate and against a front surface of said lower portion of said slide collar so as to extend rigidly between said slide collar and said lifting plate for resisting bending moments applied to said front edge of said lifting plate.

13. The system of claim 12 wherein a pair of apertures are formed in said lifting plate on opposite lateral sides thereof, said pair of apertures spaced apart substantially equally from opposite lateral sides of said slide collar, said pair of apertures for receiving therethrough said pair of lifting rods, wherein said lifting plate is mounted to said pair of lifting rods by a second pair of position locks selectively engageable so as to lockably engage between said pair of lifting rods and said lifting plate.

14. A method tor mounting a lifting bracket on an anchor pier for lifting horizontal building supports such as foundations, the method comprising the steps of:

a) providing a lifting plate, a gusset plate and a slide collar, wherein said slide collar is elongate and sized to fit snugly over an exposed upper end of the anchor pier for sliding engagement thereon, and wherein said lifting plate is mounted to said slide collar so as to extend cantilevered in a first direction substantially orthogonally therefrom, and so as to leave at least an upper portion of said slide collar extending upwardly from said lifting plate, and wherein said gusset plate rigidly mounted at a lower edge thereof to an upper surface of said lifting plate so as to extend substantially entirely across said lifting plate in substantially a second direction orthogonal to said first direction, said gusset plate rigidly mounted at at least an upper portion thereof to said at least an upper portion of said slide collar disposed above said lifting plate, said gusset plate extending rigidly from said at least an upper portion of said slide collar to said lifting plate, a plurality of apertures formed in said gusset plate so that corresponding fasteners when journalled through said apertures extend parallel to said first direction so as to engage a side surface of a building support when, a lower edge of the building support is resting on said lifting plate with the side surface abutting said gusset plate, and wherein said lifting plate has a forward edge for engaging in said first direction under the building support and a rear edge opposite said front edge, and wherein said slide collar is mounted to said lifting plate adjacent said rear edge of said lifting plate, and wherein said gusset plate is mounted substantially orthogonally to said lifting plate on a front side of said slide collar opposite an opposite rear side of said slide collar adjacent said rear edge of said lifting plate, b) fitting said slide collar over the exposed upper end of the anchor pier in sliding engagement thereon, c) engaging in said first direction said forward edge of said lifting plate under the building support so as to bring said gusset plate adjacent the side surface of the building support, d) fastening said gusset plate to the side surface of the building support by journalling fasteners through, said apertures in said gusset plate, e) elevating the slide, collar relative to the anchor pier.

15. The method of claim 14 further comprising providing a substantially parallel pair of lifting rods mounted to said lifting plate so as to extend vertically upwardly therefrom and spaced substantially equally from opposite lateral sides of said slide collar, and using said pair of lifting rods for said step of elevating said slide collar by tensioning said pair of lifting rods upwardly.

16. The method of claim 5 further comprising providing a rigid first cross member and mounting said first cross member on top of the exposed upper end of the anchor pier so as to bring opposite ends of said first cross member into proximity to said pair of rods, and providing a first pair of position locks cooperating with said ends of said first cross member and selectively engaging said first pair of position locks with said pair of lifting rods to selectively prevent movement of said pair of lifting rods relative to said first cross member when said lifting bracket is hoisted on said pair of lifting rods to elevate the building support relative to the anchor pier to a desired elevation, hoisting said lifting bracket on said pair of lifting rods to elevate said slide collar and the building support relative to the anchor pier.

17. The method of claim 16 further comprising providing a rigid second cross member rigidly mounted to, so as to extend between upper ends of said pair of lifting rods, and providing a lifting jack to elevate said second cross member, and elevating said second cross member relative to said first cross member to said hoist said lifting bracket.

18. The method of claim 17 wherein said lifting jack is a selectively actuable jack mounted between, so as to engage, said first and second cross members between said pair of lifting rods, and extending said jack to elevate said second cross member and said pair of lifting rods and said lifting plate relative to said first cross member and the anchor pier to thereby elevate the building support resting on said lifting plate.

19. The method of claim 18 further comprising engaging said first pair of position locks with said pair of lifting rods and said first cross member to lock the vertical position of said pair of lifting rods and said lifting bracket relative to the anchor pier once the lifting plate and building support have been elevated.

* * * * *